US012698912B2

(12) United States Patent
Dai et al.

(10) Patent No.: US 12,698,912 B2
(45) Date of Patent: Aug. 4, 2026

(54) METHOD FOR CONTROLLING HUMIDIFIER, APPARATUS, HUMIDIFIER, AND STORAGE MEDIUM

(71) Applicant: Shenzhen Hesung Innovation Technology Co., LTD, Shenzhen (CN)

(72) Inventors: Xianglu Dai, Shenzhen (CN); Jun Ye, Shenzhen (CN); Aimin He, Shenzhen (CN)

(73) Assignee: Shenzhen Hesung Innovation Technology Co., LTD, Shenzhen (CN)

( * ) Notice: Subject to any disclaimer, the term of this patent is extended or adjusted under 35 U.S.C. 154(b) by 357 days.

(21) Appl. No.: 18/477,485

(22) Filed: Sep. 28, 2023

(65) Prior Publication Data

US 2025/0012465 A1 Jan. 9, 2025

(30) Foreign Application Priority Data

Jul. 5, 2023 (CN) ..... 202310816626.9

(51) Int. Cl.
*F24F 11/00* (2018.01)
*F24F 110/20* (2018.01)

(52) U.S. Cl.
CPC ..... *F24F 11/0008* (2013.01); *F24F 2110/20* (2018.01)

(58) Field of Classification Search
CPC ..... F24F 1/0087; F24F 11/64; F24F 11/65; F24F 11/88; F24F 11/89; F24F 110/10; F24F 110/20; F24F 11/0008
See application file for complete search history.

(56) References Cited

FOREIGN PATENT DOCUMENTS

| | | | | | |
|---|---|---|---|---|---|
| CN | 111854121 A | * | 10/2020 | ..... | F24F 11/89 |
| CN | 109974177 B | * | 3/2021 | ..... | F24F 11/70 |
| CN | 110057043 B | * | 4/2021 | ..... | F24F 11/88 |
| CN | 111854121 B | * | 8/2021 | ..... | F24F 11/64 |
| CN | 114484810 A | * | 5/2022 | ..... | F24F 11/64 |
| CN | 116857771 B | * | 8/2024 | ..... | F24F 11/00 |
| EP | 2088381 A1 | * | 8/2009 | ..... | F24F 11/66 |

* cited by examiner

*Primary Examiner* — Thomas K Pham
(74) *Attorney, Agent, or Firm* — Nicholas Makridakis

(57) ABSTRACT

Provided are a humidifier control method, an apparatus, a humidifier, and a storage medium. The method for controlling the humidifier includes that: the humidifier is controlled to humidify an environment in a first operating state for a first preset time; a first humidity detection value of the humidifier in the first operating state is acquired; the humidifier is controlled to enter a second operating state from the first operating state for a second preset time; a second humidity detection value of the humidifier in the second operating state is acquired; a current environment humidity is determined according to the first humidity detection value and the second humidity detection value; and the operating state of the humidifier is controlled according to a difference between a preset target humidity and the current environment humidity to adjust the current environment humidity to the preset target humidity.

18 Claims, 4 Drawing Sheets

METHOD FOR CONTROLLING HUMIDIFIER, APPARATUS, HUMIDIFIER, AND STORAGE MEDIUM

CROSS-REFERENCE TO RELATED APPLICATION(S)

This application claims priority to Chinese Patent Application No. 2023108166269 filed Jul. 5, 2023, the disclosure of which is incorporated herein by reference in its entirety.

TECHNICAL FIELD

Embodiments of the present disclosure relate to the field of air humidity controls and, in particular, to a humidifier control method, an apparatus, a humidifier, and a storage medium.

BACKGROUND

Humidifiers are household appliances which are widely used by residents. The types of humidifiers in the related art are mainly divided into an ultrasonic atomization type humidifier, a heating boiling heat evaporation type humidifier and a mist-free cold evaporation type humidifier.

Among the above-described three types of humidifiers, the ultrasonic atomization humidifier has the highest market share due to the advantages of low noise, low power consumption and low cost. The operating principle of the ultrasonic atomization humidifier is that liquid water is vibrated into small water particles with micron-sized diameters by using ultrasonic waves, the water particles are flushed out of the humidifier and blown to the high altitude by an additional fan, the water particles flushed out of the humidifier gradually decelerate and turn to fall under the action of air resistance and self-gravity, most of the water particles are gasified and become water vapor in this process, and part of the water particles are still not evaporated when they fall to a placing table of the humidifier or the ground. This causes the water particles to collect mainly in the vicinity of the humidifier and to be continuously vaporized, so that the humidity of the air around the humidifier rises faster than that of other regions of the room, and a humidity sensor disposed in the humidifier body is always in a high humidity environment when the humidifier is in operation, and the sensed humidity value deviates greatly from an actual average humidity value in the room. Therefore, the ultrasonic atomization humidifier in the related art is difficult to accurately control the indoor humidity of the user within the target range set by the user, that is, the actual humidification range is difficult to match with the target humidity set by the user, and thus the use experience is poor.

Some manufacturers have made a split-type humidity sensing module or put a humidity sensor on a remote controller in order to solve the above-described problems. The above-described scheme not only increases the cost, but also brings additional problems. For example, the humidity sensing module needs to be powered independently, is easily affected by the installation position, and is restricted in the communication distance between the humidity sensing module and the humidity sensor. For example, in the scheme that the sensor is placed on the remote controller, it is susceptible to affected by the inaccurate detection due to the remote controller being wrapped, by the loss of the remote control, and by the constraints of the communication distance of the remote controller.

SUMMARY

An embodiment of the present disclosure provides a humidifier control method, an apparatus, a humidifier, and a storage medium, which achieve the effects of the accurate detection of the environment humidity and good humidification experience.

According to an aspect of the present disclosure, a humidifier control method is provided. The method includes that: the humidifier is controlled to humidify an environment in a first operating state for a first preset time; a first humidity detection value of the humidifier in the first operating state is acquired; the humidifier is controlled to enter a second operating state from the first operating state for a second preset time; a second humidity detection value of the humidifier in the second operating state is acquired; a current environment humidity is determined according to the first humidity detection value and the second humidity detection value; and the operating state of the humidifier is controlled according to a difference between a preset target humidity and the current environment humidity to adjust the current environment humidity to the preset target humidity.

Further, the first humidity detection value is a humidity value acquired according to a preset first frequency when the humidifier is in the first operating state, and the first operating state is to humidify the environment according to a mist output of a preset humidification gear.

Further, the second humidity detection value is one of an average value, an average value of partial values, a minimum value, or a median value of humidity values acquired according to a preset second frequency when the humidifier is in the second operating state, and the second operating state is to humidify the environment by outputting a mist output lower than a preset humidification gear, or to stop a mist output.

Further, that the current environment humidity is determined according to the first humidity detection value and the second humidity detection value includes that: the current environment humidity is determined according to a summation of a first weight product of the first humidity detection value and a second weight product of the second humidity detection value.

Further, that the current environment humidity is determined according to the first humidity detection value and the second humidity detection value includes that: the current environment humidity is determined according to a summation of a first weight product of an average value of multiple first humidity detection values successively detected, a second weight product of the second humidity detection value, and a third weight product of a history second humidity detection value.

Further, the method further includes that: the humidifier is controlled to display, at a preset third frequency, the current environment humidity, a target environment humidity, and a preset number of historical environment humidity.

Further, the second preset time is less than the first preset time and greater than a preset time threshold.

According to another aspect of the present disclosure, a humidification control apparatus is provided. The apparatus includes a first state module, a first detection module, a second state module, a second detection module, a humidity determining module and a humidification adjustment module. The first state module is configured to control the humidifier to humidify an environment in a first operating state for a first preset time. The first detection module is configured to acquire a first humidity detection value of the humidifier in the first operating state. The second state module is configured to control the humidifier to enter a second operating state from the first operating state for a second preset time. The second detection module is configured to acquire a second humidity detection value of the humidifier in the second operating state. The humidity determining module is configured to determine a current environment humidity according to the first humidity detection value and the second humidity detection value. The humidification adjustment module is configured to control the operating state of the humidifier according to a difference between a preset target humidity and the current environment humidity to adjust the current environment humidity to the preset target humidity.

According to another aspect of the present disclosure, a humidifier is provided. The humidifier includes one or more processors and a memory configured to store one or more programs. The one or more programs, when executed by the one or more processors, cause the one or more processors to implement the method for controlling the humidifier described above.

According to another aspect of the present disclosure, a non-transitory computer readable storage medium is provided. The computer readable storage medium stores a computer program. The computer program, when executed by a processor, implements the method for controlling the humidifier described above.

According to the method for controlling the humidifier provided in this embodiment, the humidifier is controlled to humidify the environment in the first operating state for the first preset time; the first humidity detection value of the humidifier in the first operating state is acquired; the humidifier is controlled to enter the second operating state from the first operating state for the second preset time; the second humidity detection value of the humidifier in the second operating state is acquired; the current environment humidity is determined according to the first humidity detection value and the second humidity detection value; and the operating state of the humidifier is controlled according to the difference between the preset target humidity and the current environment humidity to adjust the current environment humidity to the preset target humidity, whereby a humidity detection curve closer to the real environment humidity can be obtained under the condition that no external sensor is adopted, the technical problem of a relatively large deviation of environment humidity sensed by a conventional humidifier itself is reduced, the environment humidifying accuracy is improved on the basis that no more sensors are adopted, and the technical effect that the humidifying experience is better is achieved. In addition, according to different environments and requirements of users for using the humidifier, the proportion of the first weight to the second weight may be adjusted adaptively, so that the humidity detection curve closer to the real environment humidity may still be obtained by using the humidifier in the method for controlling the humidifier in this embodiment even in different application environments or operating modes, and thus it is ensured that the humidifier has the better use experience in different application environments or operating modes.

BRIEF DESCRIPTION OF DRAWINGS

In order to more clearly explain the technical schemes in embodiments of the present disclosure, the drawings used for describing the embodiments will be briefly introduced below. Obviously, the drawings in the following description are merely some embodiments of the present disclosure. For those of ordinary skill in the art, other drawings may also be obtained without creative labor according to these drawings.

DETAILED DESCRIPTION

In order that those skilled in the art will better understand the schemes of the present disclosure, the technical solutions adopted, and the technical effects to be achieved by the present disclosure, the technical schemes of embodiments of the present disclosure will be clearly and completely described below in conjunction with the accompanying drawings of the embodiments of the present disclosure. Apparently, the described embodiments are merely some embodiments of the present disclosure, rather than all of the embodiments. All other embodiments obtained by those of ordinary skill in the art based on the embodiments of the present disclosure without needing creative efforts shall all fall in the scope of protection of the present disclosure.

It should be noted that the terms "first", "second" and the like in the Description and claims of the present disclosure, and in the foregoing drawings, are used for distinguishing between similar objects and not necessarily for describing a particular order or sequential order. It should be understood that the data so used are interchangeable as appropriate so that embodiments of the present disclosure described herein can be implemented in an order other than those illustrated or described herein. Moreover, the terms "include" and "have" as well as any variations thereof, are intended to cover a non-exclusive inclusion, for example, a process, a method, a system, a product, or a device that includes a series of steps or units is not necessarily limited to those steps or units expressly listed, but may include other steps or units not expressly listed or inherent to such process, method, product, or device.

Embodiment One

Figure 1:
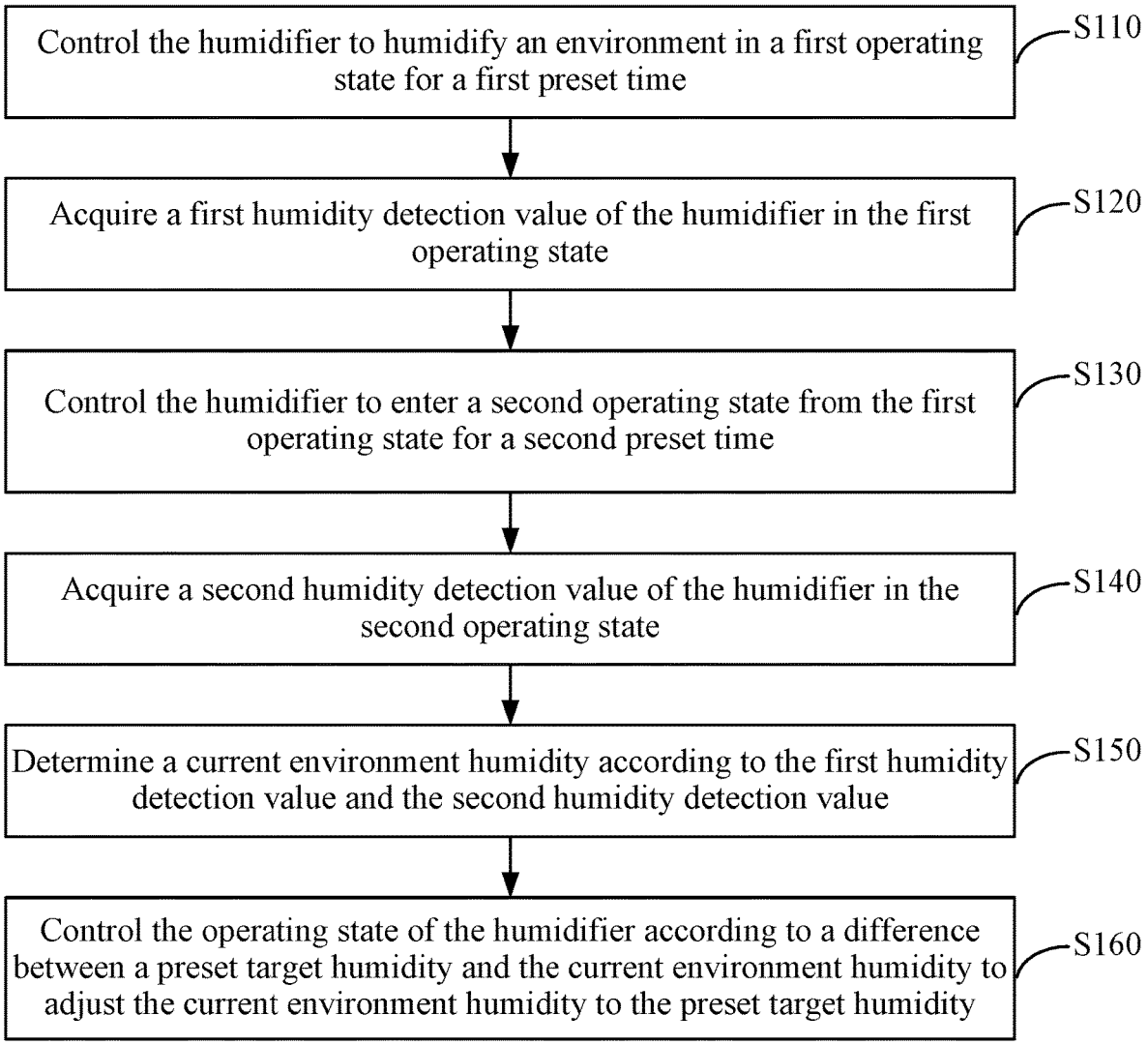
FIG. 1 is a flowchart of a humidifier control method according to an embodiment one of the present disclosure.
Figure 2:
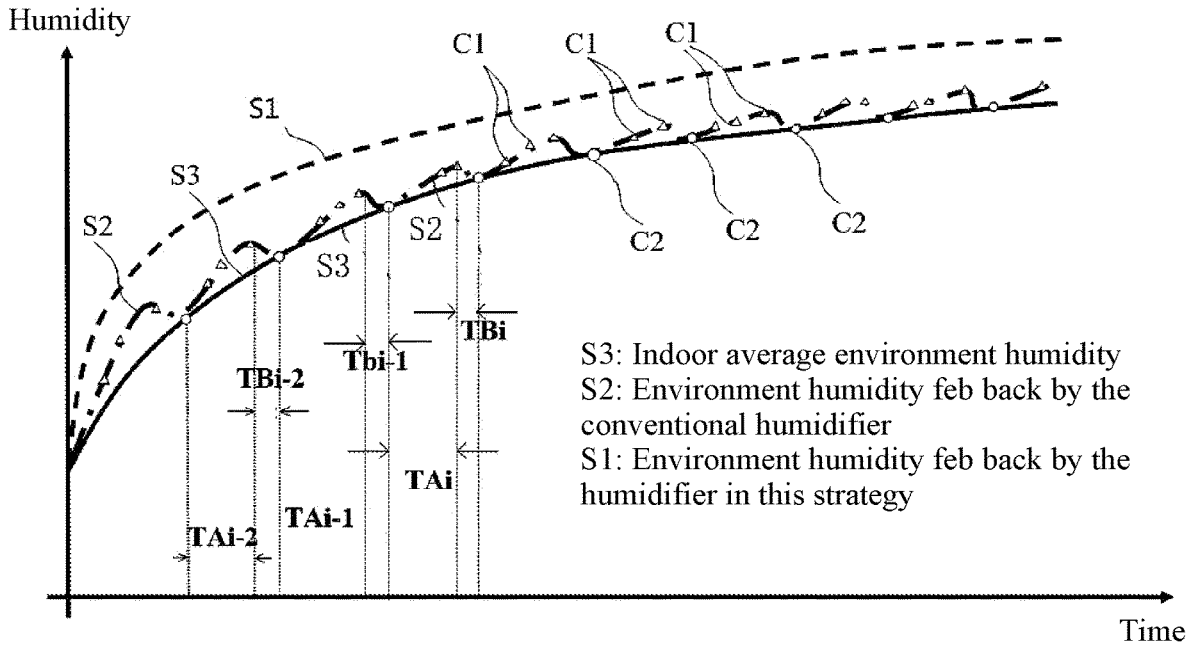
FIG. 2 is a schematic diagram of a humidity detection curve acquired by a humidifier control method according to an embodiment one of the present disclosure.

FIG. 1 is a flowchart of a humidifier control method according to an embodiment one of the present disclosure. FIG. 2 is a schematic diagram of a humidity detection curve acquired by a humidifier control method according to an embodiment one of the present disclosure. This embodiment may be implemented by a humidification control apparatus, the apparatus may be implemented in software and/or hardware, and may generally be integrated into the humidifier. Correspondingly, as shown in FIG. 1, the method includes the following operations.

In S110, the humidifier is controlled to humidify an environment in a first operating state for a first preset time.

In this embodiment, the first operating state is to humidify the environment according to a mist output amount of the preset humidification gear. Specifically, the first operating state is a normal operating state of the humidifier, that is, when the user needs to adjust the indoor humidity by using the humidifier, the user turns on the humidifier and sets a corresponding humidification gear and wind speed, and the humidifier controls the humidifier to generate water mist particles at a set humidification gear, and the wind generated by a fan blows out into the air to adjust the indoor humidity by a mist output corresponding to the humidification gear. The first preset time in this embodiment may be any one of TAi-2, TAi-1 or TAi as shown in FIG. 2, and may be specifically 5 minutes to 15 minutes, such as 9 minutes.

In S120, a first humidity detection value of the humidifier in the first operating state is acquired.

Specifically, when the humidifier is in the first operating state, a current environment humidity is acquired as the first humidity detection value by the humidity sensor of the humidifier itself. In this embodiment, the first humidity detection value is a humidity value acquired according to a preset first frequency when the humidifier is in the first operating state, for example, acquired at a time point C1 shown in FIG. 2. Preferably, the first frequency is 10 to 100 acquisition times per second, such as 10 times.

In S130, the humidifier is controlled to enter a second operating state from the first operating state for a second preset time.

In this embodiment, the second operating state is to humidify the environment by outputting a mist output lower than a preset humidification gear, or to stop a mist output. Specifically, the second operating state is to use a gear lower than the humidification gear of the first operating state to control the mist output to humidify the environment. That is, the second operating state is an operating state in which the mist output generated by the humidifier is reduced. In an embodiment, when the user humidifies the indoor humidity by using the humidification gear 3 and the wind speed gear 3 of the humidifier and operates for the first preset time such as 9 minutes, the humidifier automatically lowers the humidification gear and/or the wind speed and operates for the second preset time such as 1 minute. In an embodiment, the actual gear for the operation of the humidifier during the second preset time may be any one of humidification gear 2 and wind speed gear 3, humidification gear 1 and wind speed gear 3, humidification gear 0 (stopping the mist output) and wind speed gear 3, humidification gear 2 and wind speed gear 4, humidification gear 1 and wind speed gear 4, or humidification gear 0 and wind speed gear 4. At this time, the humidifier generates less water mist particles or stops the mist output at the adjusted humidification gear and/or wind speed control humidifier, and the wind generated by the fan is blown into the air to humidify the environment or stop humidifying the environment at a mist output amount lower than the preset humidification gear, so that less mist is collected around the humidifier, and the environment humidity sensed by the built-in humidity sensor of the humidifier is more accurate. The second preset time of this embodiment may be any one of TBi-2, TBi-1 or TBi shown in FIG. 2, and may be specifically 0.5 minutes to 2 minutes, such as 1 minute.

In this embodiment, the second preset time is less than the first preset time and greater than the preset time threshold, and the preset time threshold may be set in the range of 0.1 minute to 1 minute, such as 30 seconds. In this way, it is ensured that there is sufficient time for the dense mist in the vicinity of the humidifier to be mixed with the environment air and vaporized into water vapor, and the accuracy of the environment humidity sensed by the built-in humidity sensor of the humidifier is further increased.

In S140, a second humidity detection value of the humidifier in the second operating state is acquired.

In this embodiment, the second humidity detection value is one of an average value, an average value of partial values, a minimum value, or a median value of humidity values acquired according to a preset second frequency when the humidifier is in the second operating state. For example, the acquisition may be performed at or near a time point C2 (a time point at which the second operating state ends or is about to end) as shown in FIG. 2. Preferably, the second frequency is acquired 10 times to 100 times per second such as 10 times.

In S150, a current environment humidity is determined according to the first humidity detection value and the second humidity detection value.

In an embodiment, that the current environment humidity is determined according to the first humidity detection value RHi and the second humidity detection value RHo includes that: the current environment humidity is determined according to a summation of a first weight product A1×RHi of the first humidity detection value RHi and a second weight product A2×Rho of the second humidity detection value Rho, that is, the current environment humidity satisfies the formula RH=A2×Rho+A1×RHi. In a preferred embodiment, the second weight A2 is greater than the first weight A1. In an embodiment, A1 has a value range of 0.6 to 0.8 and A2 has a value range of 0.4 to 0.2. Preferably, A1=0.8, A2=0.2. In this embodiment, A2+A1=1.

In an alternative embodiment, that the current environment humidity is determined according to the first humidity detection value and the second humidity detection value may further include that: the current environment humidity is determined according to a summation of a first weight product A1×(RHi−n+ . . . +RHi−2RHi−1+RHi)/(n+1) of an average value (RHi−n+ . . . +RHi−2RHi−1+RHi)/(n+1) of multiple first humidity detection values successively detected, a second weight product A2×RHo1 of the current second humidity detection value RHo1, and a third weight product A3×RHo2 of a history second humidity detection value RHo2, that is, the current environment humidity satisfies the formula: RH=A3×RHo2+A2×RHo1+A1×(RHi−n+ . . . +RHi−2+RHi−1+RHi)/(n+1). Where a value range of A2 is 0.5 to 0.8, a value range of A3 is 0.1 to 0.3, a value range of A1 is 0.1 to 0.3, and a preferred value range of n is 2 to 10. Preferably, A2=0.6, A1=0.2, A3=0.2, n=3, that is, the current environment humidity satisfies the preferred formula RH=0.2×RHo2+0.6×RHo1+0.2×(RHi−3+RHi−2+RHi−1+RHi)/(3+1). In this embodiment, A1+A2+A3=1.

In this embodiment, the current second humidity detection value RHo1 may be a second humidity detection value acquired within the second preset time TBi of the current stage, and the historical second humidity detection value RHo2 may be a second humidity detection value acquired within the second preset time TBi−1 of the previous stage. Among the multiple first humidity detection values RHi−n . . . , RHi−2, RHi−1, and RHi detected in succession, RHi is the latest humidity detection result, and RHi−1 and RHi−2 . . . RHi−n is an earlier humidity detection result and is in turn remote from the latest humidity detection result. Specifically, RHi, RHi−1, RHi−2 . . . RHi−n may all be multiple consecutive detection results acquired within the first preset time TAi. In an alternative embodiment, RHi may be a first humidity detection value acquired within the first preset time TAi, RHi−1 is a first humidity detection value acquired within the first preset time TAi−1 of a previous stage, RHi−2 is a first humidity detection value acquired within the first preset time TAi−2 of a further stage, and so on, and RHi−n is a first humidity detection value acquired within the first preset time TAi−n.

The current environment humidity acquired by using the method of this embodiment is shown by a curve S2 in FIG.

2, the current environment humidity acquired by using the method in the related art is shown by a curve S1 in FIG. 2, and an average value of the current environment humidity acquired by the external humidity sensor is shown by a curve S3 in FIG. 2. Obviously, the current environment humidity acquired by using the method of this embodiment is closer to the real environment humidity.

In S160, the operating state of the humidifier is controlled according to a difference between a preset target humidity and the current environment humidity to adjust the current environment humidity to the preset target humidity.

After the current environment humidity is determined according to the above-described steps, if the current environment humidity is less than the target humidity set by the user, then the it is controlled to increase the humidification gear and/or the wind speed so as to increase the current environment humidity to the target humidity set by the user. If the current environment humidity is greater than the target humidity set by the user, then it is controlled to reduce the humidification gear and/or the wind speed so as to reduce the current environment humidity to the target humidity set by the user.

In an alternative embodiment, if the current environment humidity is less than the target humidity set by the user, then it is controlled to increase a ratio of the first preset time to the second preset time, for example, an original ratio of 9:1 is adjusted to a ratio of 9.5:0.5 so as to increase the mist output to increase the current environment humidity to the target humidity set by the user. If the current environment humidity is greater than the target humidity set by the user, then it is controlled to reduce a ratio of the first preset time to the second preset time, for example, an original ratio of 9:1 is adjusted to 8.5:1.5 so as to reduce the current environment humidity to the target humidity set by the user.

In other alternative embodiments, the humidification gear, the wind speed, and/or a ratio of the first preset time to the second preset time may be adjusted simultaneously to adjust the environment humidity to the preset target humidity in conjunction with the previous two humidity adjustment manners.

Further, the method further includes a display step. In the display step, the humidifier is controlled to display the current environment humidity, the target environment humidity, and a preset number of historical environment humidity at a preset third frequency. In this embodiment, the third frequency is less than the first frequency and the second frequency, for example, the third frequency may be updated with the current environment humidity data once per second.

Compared with the related art, in the method for controlling the humidifier in this embodiment, the detected environment humidity is corrected by using the data of the sensors acquired at two different stages, so that a humidity detection curve closer to the real environment humidity can be obtained under the condition that no external sensor is adopted, the technical problem of a relatively large deviation of environment humidity sensed by a conventional humidifier itself is reduced, the environment humidifying accuracy is improved on the basis that no more sensors are adopted, and the technical effect that the humidifying experience is better is achieved. In addition, according to different environments and requirements of users for using the humidifier, the proportion of the first weight to the second weight may be adjusted adaptively, so that the humidity detection curve closer to the real environment humidity may still be obtained by using the humidifier in the method for controlling the humidifier in this embodiment even in different application environments or operating modes, and thus it is ensured that the humidifier has better use experience in different application environments or operating modes.

Embodiment Two

Figure 3:
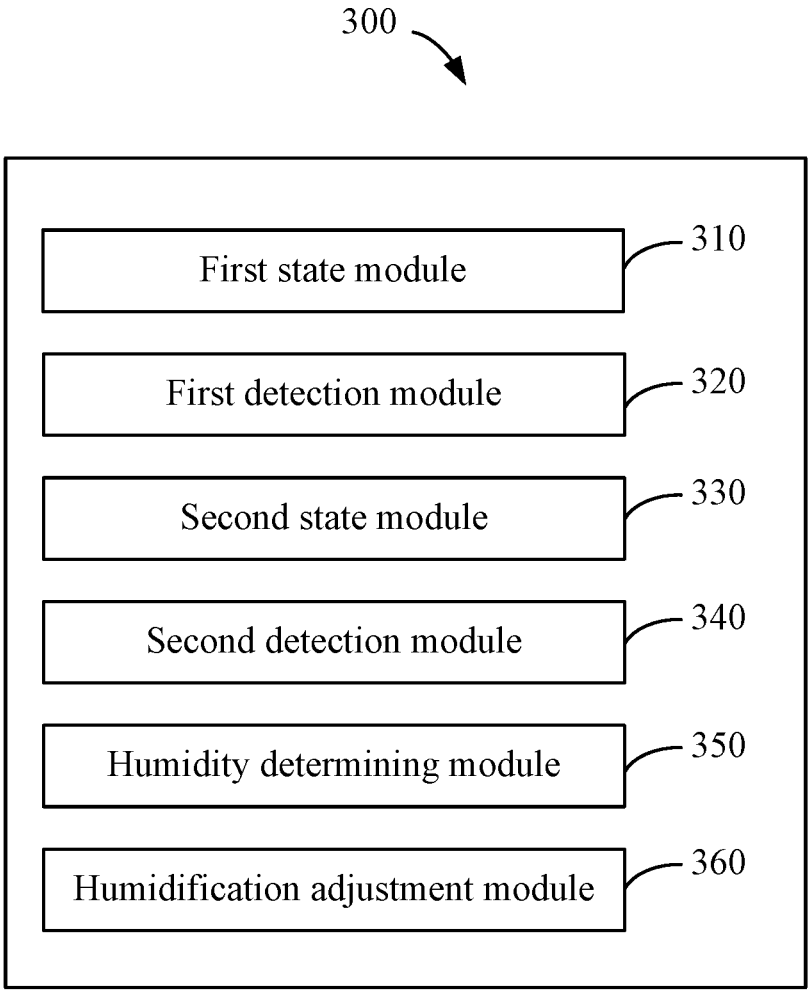
FIG. 3 is a schematic structural diagram of a humidification control apparatus according to an embodiment two of the present disclosure.
Figure 4:
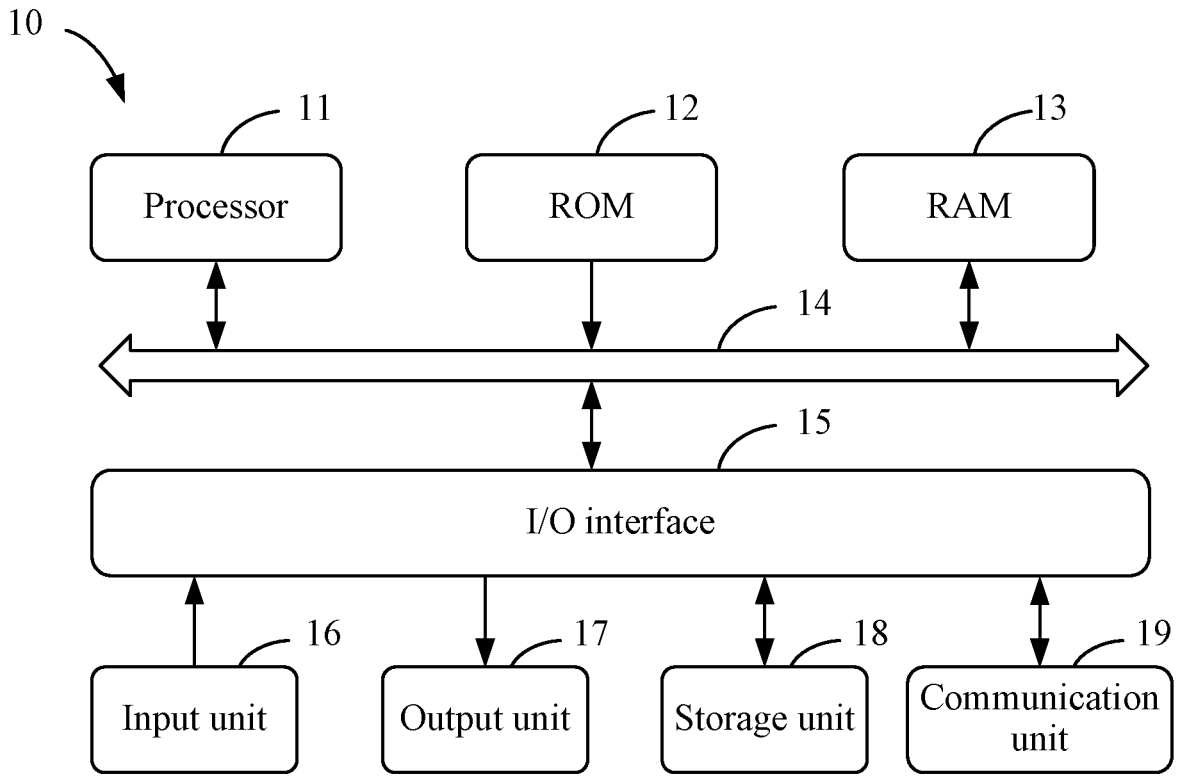
FIG. 4 is a schematic structural diagram of a humidifier according to an embodiment three of the present disclosure.

FIG. 3 is a schematic diagram of a humidification control apparatus according to an embodiment two of the present disclosure. The apparatus 300 may be implemented in software and/or hardware and may be generally integrated with a humidifier. As shown in FIG. 3, the apparatus 300 includes a first state module 310, a first detection module 320, a second state module 330, a second detection module 340, a humidity determining module 350 and a humidification adjustment module 360. The first state module 310 is configured to control the humidifier to humidify an environment in a first operating state for a first preset time. The first detection module 320 is configured to acquire a first humidity detection value of the humidifier in the first operating state. The second state module 330 is configured to control the humidifier to enter a second operating state from the first operating state for a second preset time. The second detection module 340 is configured to acquire a second humidity detection value of the humidifier in the second operating state. The humidity determining module 350 is configured to determine a current environment humidity according to the first humidity detection value and the second humidity detection value. The humidification adjustment module 360 is configured to control the operating state of the humidifier according to a difference between a preset target humidity and the current environment humidity to adjust the current environment humidity to the preset target humidity.

In this embodiment, the second preset time is less than the first preset time and greater than a preset time threshold.

Further, the apparatus 300 further includes a first frequency control module configured to control a preset first frequency of the humidifier in the first operating state. In this embodiment, the first humidity detection value is a humidity value acquired according to the preset first frequency when the humidifier is in the first operating state, and the first operating state is to humidify the environment according to a mist output of a preset humidification gear.

Further, the apparatus 300 further includes a second frequency control module configured to control a preset second frequency of the humidifier in the second operating state. In this embodiment, the second humidity detection value is one of an average value of humidity values, an average value of partial values, a minimum value, or a median value acquired according to the preset second frequency when the humidifier is in the second operating state, and the second operating state is to humidify the environment by outputting a mist output lower than a preset humidification gear, or to stop a mist output.

Further, the humidity determining module 350 is further configured to determine the current environment humidity according to a summation of a first weight product of the first humidity detection value and a second weight product of the second humidity detection value.

Further, the humidity determining module 350 is further configured to determine the current environment humidity according to a summation of a first weight product of a first humidity detection value among multiple first humidity detection values, a second weight product of the history first humidity detection value, and a third weight product of an average value of multiple second humidity detection value successively detected.

Further, the apparatus 300 further includes a display module. The display module is configured to control the humidifier to display the current environment humidity, a target environment humidity, and a preset number of historical environment humidity at a preset third frequency.

The above-described humidification control apparatus may execute the method for controlling the humidifier provided in any of the embodiments of the present disclosure, and has corresponding functional modules and beneficial effects for executing the method. For technical details which are not described in detail in this embodiment, reference may be made to the method for controlling the humidifier provided in any of the embodiments of the present disclosure. The apparatus for controlling the humidifier described above is an apparatus that may execute the method for controlling the humidifier in the embodiments of the present disclosure, therefore, based on the method for controlling the humidifier described in the embodiments of the present disclosure, those skilled in the art may understand the specific implementations and various modifications thereof of the apparatus for controlling the humidifier in this embodiment, therefore, how the apparatus for controlling the humidifier to implement the method for controlling the humidifier provided in the embodiments of the present disclosure will not be described in detail herein. Any apparatus used by those skilled in the art to implement the method for controlling the humidifier provided in the embodiments of the present disclosure shall belong to the scope of protection of the present disclosure.

Embodiment Three

FIG. 3 shows a schematic structural diagram of a humidifier according to an embodiment three of the present disclosure. As shown in FIG. 3, the humidifier 10 includes at least one processor 11, and a memory communicatively connected to the at least one processor 11, such as a read-only memory (ROM) 12, and a random access memory (RAM) 13. The memory stores a computer program executable by the at least one processor, and the processor 11 may perform various appropriate actions and processes according to a computer program stored in the read-only memory (ROM) 12 or a computer program loaded from a storage unit 18 into the random access memory (RAM) 13. In RAM 13, various programs and data required for the operation of the humidifier 10 may also be stored. The processors 11, the ROM 12 and the RAM 13 are connected to each other via a bus 14. An input/output (I/O) interface 15 is also connected to the bus 14.

Multiple components in the humidifier 10 are connected to the I/O interface 15, and the multiple components include an input unit 16 such as a keyboard or a mouse; an output unit 17 such as various types of displays or speakers; a storage unit 18 such as a magnetic disk or an optical disk; and a communication unit 19 such as a network card, a modem, or a wireless communication transceiver. The communication unit 19 allows the humidifier 10 to exchange information/data with other devices over a computer network such as the Internet and/or various telecommunications networks.

The processor 11 may be a variety of general-purpose and/or dedicated processing assemblies having processing and computing capabilities. Some examples of the processor 11 include, but are not limited to, a central processing unit (CPU), a graphics processing unit (GPU), various special-purpose artificial intelligence (AI) computing chips, various processors executing machine learning model algorithms, a digital signal processors (DSP), and any suitable processor, controller and microcontrollers. The processor 11 performs the various methods and processes described above, such as the method for controlling the humidifier.

In some embodiments, the method for controlling the humidifier may be implemented as computer programs, and the computer programs are tangibly embodied in a computer readable storage medium, such as a storage unit 18. In some embodiments, part or all of computer programs may be loaded and/or installed on the humidifier 10 via the ROM 12 and/or the communication unit 19. When the computer program is loaded into the RAM 13 and executed by the processor 11, one or more steps of the method for controlling the humidifier described above may be executed. Alternatively, in other embodiments, the processor 11 may be configured, in any other suitable manners (such as, by means of firmware), to perform the method for controlling the humidifier.

Various implementations of the systems and techniques described above herein may be implemented in digital electronic circuit systems, integrated circuit systems, field-programmable gate arrays (FPGAs), application-specific integrated circuits (ASICs), application-specific standard products (ASSPs), systems on chip (SOCs), complex programmable logic devices (CPLDs), computer hardware, firmware, software, and/or combinations thereof. These various implementations may include implementation in one or more computer programs, and the one or more computer programs are executable and/or interpretable on a programmable system including at least one programmable processor, the programmable processor may be a special-purpose or general-purpose programmable processor for receiving data and instructions from a memory system, at least one input device and at least one output device and transmitting data and instructions to the memory system, the at least one input device and the at least one output device.

The computer program for implementing the methods of the present disclosure may be written in any combination of one or more programming languages. These computer programs may be provided for the processor or controller of a general-purpose computer, a special-purpose computer, or another programmable data processing device to enable the functions/operations specified in a flowchart and/or a block diagram to be implemented when the program codes are executed by the processor or controller. The computer program may be executed entirely on the machine, partly on the machine, as a stand-alone software package, partly on the remote machine or entirely on the remote machine, or entirely on the remote machine or server.

In the context of the present disclosure, a machine readable medium may be a tangible medium that may contain or store a computer program available for an instruction execution system, apparatus or device or a computer program used in conjunction with an instruction execution system, apparatus or device. The machine readable medium may include, but is not limited to, an electronic, magnetic, optical, electromagnetic, infrared, or semiconductor system, apparatus, or device, or any appropriate combination of the foregoing. Alternatively, the computer readable storage medium may be a machine readable signal medium. More specific examples of the machine readable storage medium may include an electrical connection based on one or more wires, a portable computer diskette, a hard disk, a random access memory (RAM), a read-only memory (ROM), an erasable programmable read-only memory (EPROM or a flash memory), an optical fiber, a portable compact disc read-only memory (CD-ROM), an optical storage device, a magnetic storage device, or any appropriate combination of the foregoing.

To provide the interaction with a user, the systems and technologies described here may be implemented on a mobile terminal. The mobile terminal has a display device (such as, a cathode-ray tube (CRT) or liquid-crystal display (LCD) monitor) for displaying information to the user; and a keyboard and a pointing apparatus (such as, a mouse or a trackball) through which the user may provide input to the mobile terminal. Other kinds of apparatuses may also be used for providing for interaction with the user; for example, feedback provided to the user may be sensory feedback in any form (such as, visual feedback, auditory feedback, or haptic feedback); and input from the user may be received in any form (including acoustic input, speech input, or haptic input).

The systems and technologies described here may be implemented in a computing system including a back-end component (such as, a data server), or a computing system including a middleware component (such as, an application server), or a computing system including a front-end component (such as, a client computer having a graphical user interface or a web browser, and the user may interact with the implementations of the systems and technologies described herein through the graphical user interface or the web browser), or a computing system including any combination of such back-end component, middleware component, or front-end component. The components of the system may be interconnected by any form or medium of digital data communication (such as, a communication network). Examples of the communication network include a local area network (LAN), a wide area network (WAN), a blockchain network and the Internet.

The computing system may include a client and a server. The client and the server are generally remote from each other and typically interact through the communication network. A relationship between the clients and the servers arises by virtue of computer programs running on respective computers and having a client-server relationship to each other. The server may be a cloud server, also referred to as a cloud computing server or a cloud host. As a host product in a cloud computing service system, the server solves the defects of difficult management and weak service scalability in a conventional physical host and a related virtual private server (VPS) service.

Embodiment Four

The fourth embodiment of the present disclosure further provides a computer storage medium storing a computer program, and the computer program is configured to perform, when executed by a computer processor, the method for controlling the humidifier according to any one of the above embodiments of the present disclosure.

The computer storage media of the embodiments of the present disclosure may adopt any combination of one or more computer-readable media. The computer-readable medium may be a computer-readable signal medium or a computer-readable storage medium. The computer-readable storage medium may be, for example, but not limited to, an electronic, magnetic, optical, electromagnetic, infrared, or semiconductor system, apparatus, or device, or any combination of the foregoing. More specific examples (a non-exhaustive list) of the computer-readable storage medium include: an electrical connection having one or more wires, a portable computer diskette, a hard disk, a random access memory (RAM), a read-only memory (ROM), an erasable programmable read-only memory (EPROM or flash memory), an optical fiber, a portable compact disc read-only memory (CD-ROM), an optical storage device, a magnetic storage device, or any suitable combination of the foregoing. In this context, the computer-readable storage medium may be any tangible medium that contains or stores a program, and the program is used for use by or in connection with an instruction execution system, apparatus, or device.

The computer-readable signal medium may include a data signal propagated in a baseband or as part of a carrier wave, and a computer-readable program code is carried in the data signal. Such a propagated data signal may adopt a variety of forms, including, but not limited to: an electromagnetic signal, an optical signal, or any suitable combination of the foregoing. The computer-readable signal medium may be any computer-readable medium that is not a computer-readable storage medium, and the computer-readable medium may transmit, propagate, or transport a program for use by or in connection with an instruction execution system, apparatus, or device.

Program codes embodied on the computer-readable medium may be transmitted using any appropriate medium, including but not limited to: wireless, wire, optic cable, radio frequency (RF) and the like, or any suitable combination of the foregoing.

The above implementations should not be construed as limiting the protection scope of the present disclosure. It should be understood by those skilled in the art that various modifications, combinations, sub-combinations and substitutions may be made depending on design requirements and other factors. Any modification, equivalent replacement, and improvement made within the spirit and principle of the present disclosure should be included within the protection scope of the present disclosure.

What is claimed is:

1. A humidifier control method, comprising:

controlling a humidifier to humidify an environment in a first operating state for a first preset time;

acquiring a first humidity detection value of the humidifier in the first operating state;

controlling the humidifier to enter a second operating state from the first operating state for a second preset time;

acquiring a second humidity detection value of the humidifier in the second operating state;

determining a current environment humidity according to the first humidity detection value and the second humidity detection value; and controlling an operating state of the humidifier according to a difference between a preset target humidity and the current environment humidity, to adjust the current environment humidity to the preset target humidity;

wherein the second humidity detection value is one of an average value, an average value of partial values, a minimum value, or a median value of humidity values acquired according to a preset first frequency when the humidifier is in the second operating state, and the second operating state is to humidify the environment by outputting a mist output lower than a preset humidification gear, or to stop a mist output.

2. The humidifier control method of claim 1, wherein the first humidity detection value is a humidity value acquired according to a preset first second frequency when the humidifier is in the first operating state, and the first operating state is to humidify the environment according to a mist output of a preset humidification gear.

3. The humidifier control method of claim 1, wherein determining the current environment humidity according to the first humidity detection value and the second humidity detection value comprises: determining the current environment humidity according to a summation of a first weight product of the first humidity detection value and a second weight product of the second humidity detection value.

4. The humidifier control method of claim 1, wherein determining the current environment humidity according to the first humidity detection value and the second humidity detection value comprises: determining the current environment humidity according to a summation of a first weight product of an average value of a plurality of first humidity detection values successively detected, a second weight product of the second humidity detection value, and a third weight product of a history second humidity detection value.

5. The humidifier control method of claim 1, further comprising: controlling the humidifier to display, at a preset third frequency, the current environment humidity, a target environment humidity, and a preset number of historical environment humidity.

6. The humidifier control method of claim 1, wherein the second preset time is less than the first preset time and greater than a preset time threshold.

7. A humidifier, comprising:

at least one processors; and a memory, which is configured to store at least one program;

wherein the at least one program, when executed by the at least one processor, causes the at least one processor to implement:

controlling the humidifier to humidify an environment in a first operating state for a first preset time;

acquiring a first humidity detection value of the humidifier in the first operating state;

controlling the humidifier to enter a second operating state from the first operating state for a second preset time;

acquiring a second humidity detection value of the humidifier in the second operating state;

determining a current environment humidity according to the first humidity detection value and the second humidity detection value; and controlling an operating state of the humidifier according to a difference between a preset target humidity and the current environment humidity, to adjust the current environment humidity to the preset target humidity;

wherein the second humidity detection value is one of an average value, an average value of partial values, a minimum value, or a median value of humidity values acquired according to a preset first frequency when the humidifier is in the second operating state, and the second operating state is to humidify the environment by outputting a mist output lower than a preset humidification gear, or to stop a mist output.

8. The humidifier of claim 7, wherein the first humidity detection value is a humidity value acquired according to a preset second frequency when the humidifier is in the first operating state, and the first operating state is to humidify the environment according to a mist output of a preset humidification gear.

9. The humidifier of claim 7, wherein the at least one processor determines the current environment humidity according to the first humidity detection value and the second humidity detection value by:

determining the current environment humidity according to a summation of a first weight product of the first humidity detection value and a second weight product of the second humidity detection value.

10. The humidifier of claim 7, wherein the at least one processor determines the current environment humidity according to the first humidity detection value and the second humidity detection value by:

determining the current environment humidity according to a summation of a first weight product of an average value of a plurality of first humidity detection values successively detected, a second weight product of the second humidity detection value, and a third weight product of a history second humidity detection value.

11. The humidifier of claim 7, wherein the at least one processor further implements:

controlling the humidifier to display, at a preset third frequency, the current environment humidity, a target environment humidity, and a preset number of historical environment humidity.

12. The humidifier of claim 7, wherein the second preset time is less than the first preset time and greater than a preset time threshold.

13. A non-transitory computer readable storage medium, storing a computer program, wherein the computer program, when executed by a processor of a humidifier, implements:

controlling the humidifier to humidify an environment in a first operating state for a first preset time;

acquiring a first humidity detection value of the humidifier in the first operating state;

controlling the humidifier to enter a second operating state from the first operating state for a second preset time;

acquiring a second humidity detection value of the humidifier in the second operating state;

determining a current environment humidity according to the first humidity detection value and the second humidity detection value; and controlling an operating state of the humidifier according to a difference between a preset target humidity and the current environment humidity, to adjust the current environment humidity to the preset target humidity;

wherein the second humidity detection value is one of an average value, an average value of partial values, a minimum value, or a median value of humidity values acquired according to a preset first frequency when the humidifier is in the second operating state, and the second operating state is to humidify the environment by outputting a mist output lower than a preset humidification gear, or to stop a mist output.

14. The non-transitory computer readable storage medium of claim 13, wherein the first humidity detection value is a humidity value acquired according to a preset second frequency when the humidifier is in the first operating state, and the first operating state is to humidify the environment according to a mist output of a preset humidification gear.

15. The non-transitory computer readable storage medium of claim 13, wherein the processor determines the current environment humidity according to the first humidity detection value and the second humidity detection value by:

determining the current environment humidity according to a summation of a first weight product of the first humidity detection value and a second weight product of the second humidity detection value.

16. The non-transitory computer readable storage medium of claim 13, wherein the processor determines the current environment humidity according to the first humidity detection value and the second humidity detection value by:

determining the current environment humidity according to a summation of a first weight product of an average value of a plurality of first humidity detection values successively detected, a second weight product of the second humidity detection value, and a third weight product of a history second humidity detection value.

17. The non-transitory computer readable storage medium of claim 13, wherein the processor further implements:

controlling the humidifier to display, at a preset third frequency, the current environment humidity, a target environment humidity, and a preset number of historical environment humidity.

18. The non-transitory computer readable storage medium of claim 13, wherein the second preset time is less than the first preset time and greater than a preset time threshold.

* * * * *